US005357328A

United States Patent [19]

Lundy

[11] Patent Number: 5,357,328

[45] Date of Patent: Oct. 18, 1994

[54] GROUND STRIP BRUSH CLEANER

[75] Inventor: Douglas A. Lundy, Webster, N.Y.

[73] Assignee: Xerox Corporation, Stamford, Conn.

[21] Appl. No.: 46,553

[22] Filed: Apr. 16, 1993

[51] Int. Cl.[5] ..... G03G 21/00

[52] U.S. Cl. ..... 355/301

[58] Field of Search ..... 355/301, 302, 303, 296

[56] References Cited

U.S. PATENT DOCUMENTS

| | | | |
|---|---|---|---|
| 3,278,972 | 10/1966 | Hudson | 355/302 X |
| 4,264,190 | 4/1981 | Tsuda et al. | 355/302 |
| 4,319,831 | 3/1982 | Matsui et al. | 355/303 |
| 4,361,922 | 12/1982 | Karal | 355/303 X |
| 4,382,673 | 5/1983 | Nakajima et al. | 355/301 X |
| 4,412,736 | 11/1983 | Sakamoto et al. | 355/302 |
| 4,673,284 | 6/1987 | Matsumoto et al. | 355/301 |
| 4,903,084 | 2/1990 | Baltrus et al. | 355/301 |
| 5,216,467 | 6/1993 | Esser et al. | 355/215 |

FOREIGN PATENT DOCUMENTS

| | | | |
|---|---|---|---|
| 60-205550 | 10/1985 | Japan | 355/301 |

*Primary Examiner*—Fred L. Braun
*Attorney, Agent, or Firm*—T. L. Fair

[57] ABSTRACT

An apparatus for cleaning particles from the imaging surface and the ground strip located along the edge of the imaging surface. The conductive cleaning brush will short with the ground strip causing copy quality defects. An insulative brush donut is attached to the conductive cleaning brush for cleaning. The insulative brush donut will not short with the ground strip and the insulative brush prevents contact between the conductive fibers and the ground strip.

10 Claims, 3 Drawing Sheets

GROUND STRIP BRUSH CLEANER

BACKGROUND OF THE INVENTION

This invention relates generally to an electrostatographic printer or copier, and more particularly concerns a cleaning apparatus used therein.

In an electrostatographic reproducing apparatus, a latent electrostatic information image is formed on an electrically insulating carrier. The latent image is developed into a visible image by the application of toner particles to the carrier surface, whereby the particles are caused to adhere electrostatically either to the portions of the carrier surface that are electrostatically charged or to the portions that are not charged and the adhered toner particles may then be transferred imagewise to an image receiving or record sheet. After the transfer, the insulating carrier is cleaned of residual toner particles and freed of the image charge pattern, and then reused in the production of another image.

Effective and efficient cleaning of the residual particles (i.e. toner and other debris) from the insulating carrier is a critical operation, since any such residual particles will interfere with a subsequent image developed on the carrier. At the same time, it is important that the cleaning operation not damage the image carrier surface. Cylindrical brushes such as an electrostatic brush are commonly used in this type of cleaning operation.

The basic function of the electrostatic brush cleaner is to carry a controlled voltage bias to remove charged toner from the photoreceptor surface. However, in cleaning the photoreceptor surface, residual particles of toner and other debris accumulate on the ground strip located along the edge(s) of the photoreceptor. This accumulation or build-up of residual particles can lead to print or copy quality defects if not removed. By its basic design, the electrostatic brush cleaner can not be used to clean the ground strip because it will short out to the grounded surface causing a print or copy quality defect.

SUMMARY OF INVENTION

Briefly stated, and in accordance with one aspect of the present invention, there is provided an apparatus for cleaning particles from a surface having an electrical ground strip along a marginal region of the surface, comprising a housing defining an open ended chamber; a brush, rotatably mounted in the chamber of the housing, for removing particles from the surface; and means, associated with the brush, for cleaning particles from the ground strip of the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
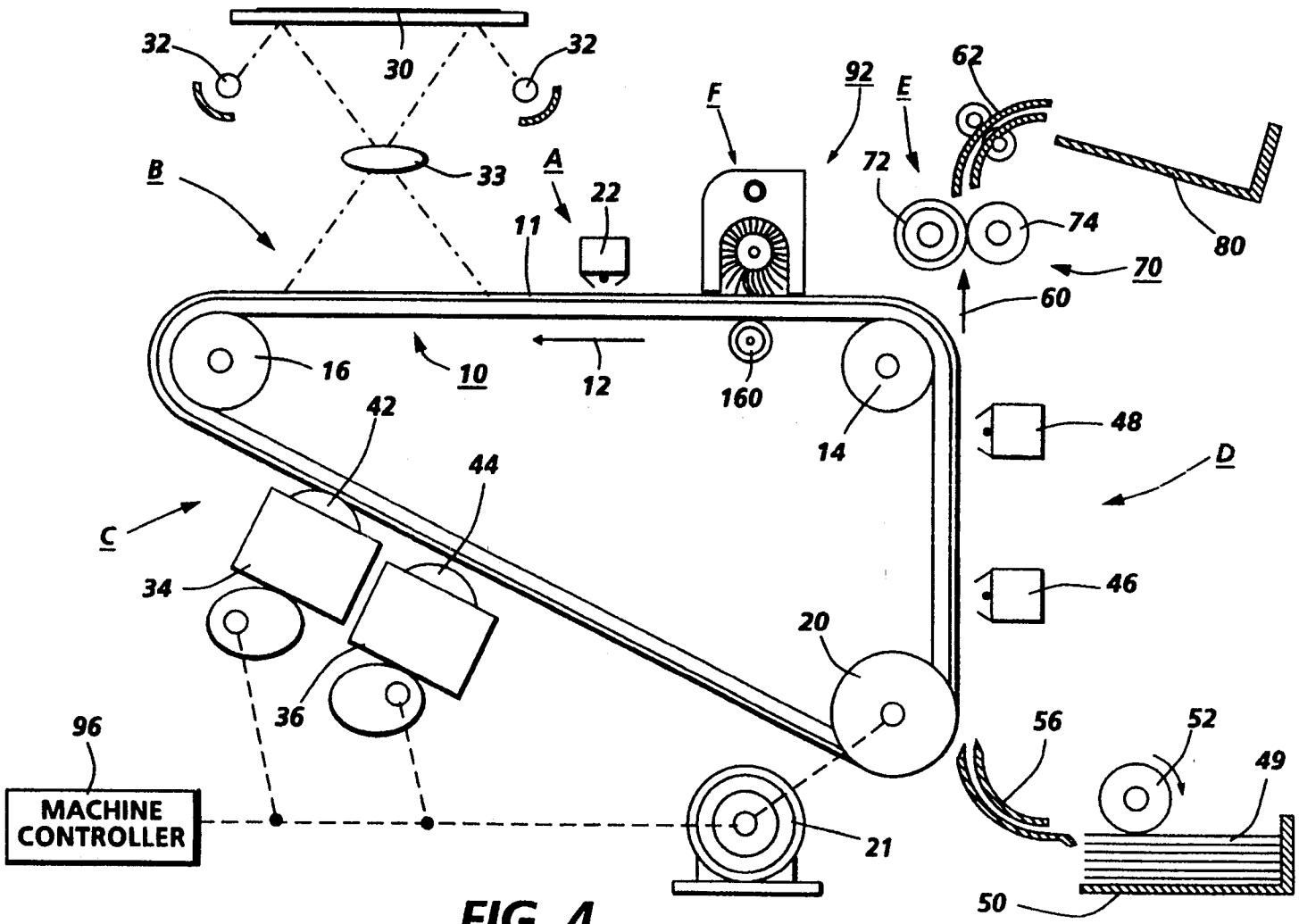
FIG. 4 is a schematic elevational view of a printing apparatus incorporating the inventive features of the invention.

For a general understanding of an electrophotographic printer or copier in which the present invention may be incorporated, reference is made to FIG. 4 which depicts schematically the various components thereof. Hereinafter, like reference numerals will be employed throughout to designate identical elements. Although the augmented electrostatic brush apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 4 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 4, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

Figure 1:
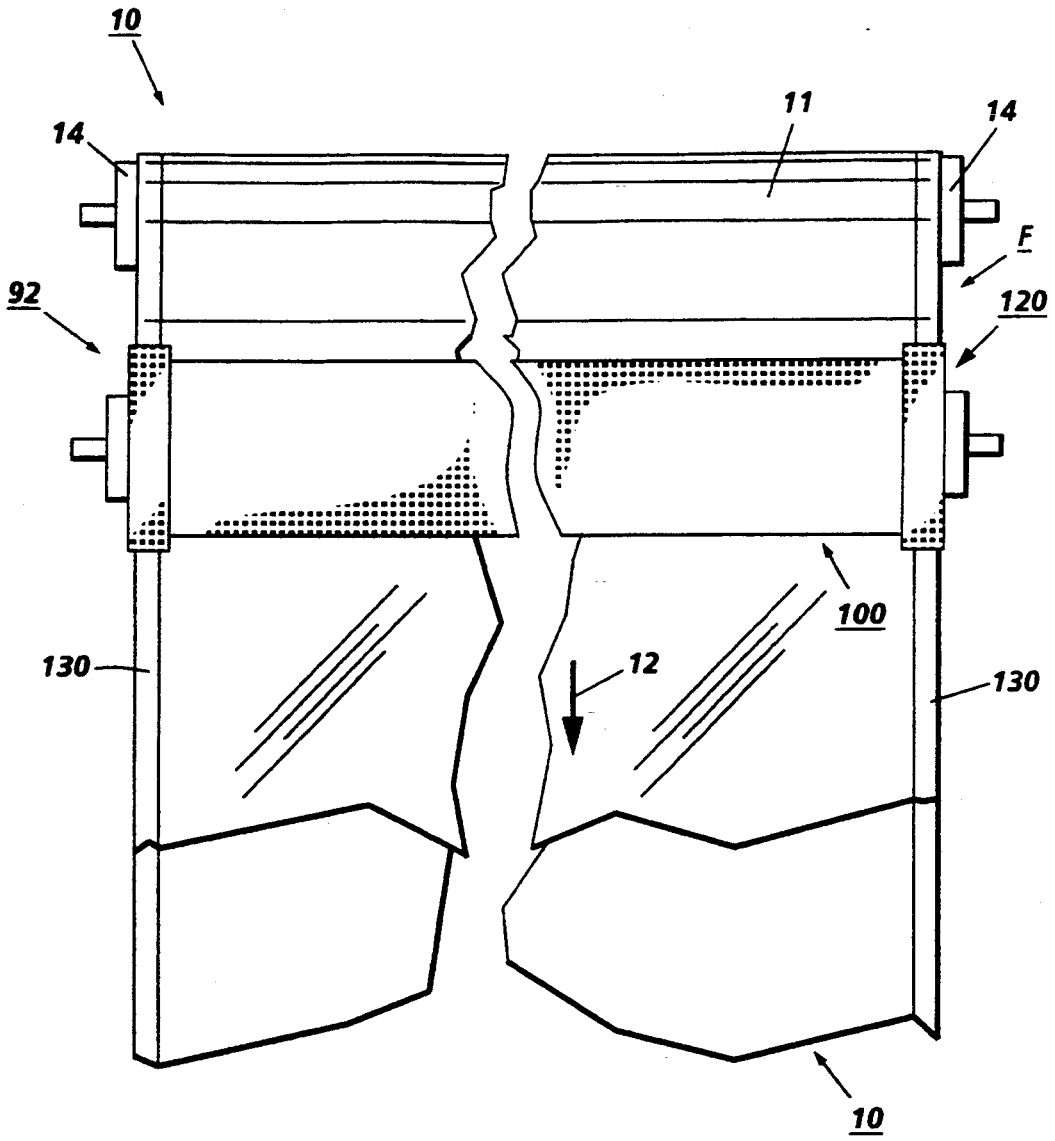
FIG. 1 is a plan view of the photoconductive belt being cleaned by the cleaning apparatus of the present invention.
Figure 2:
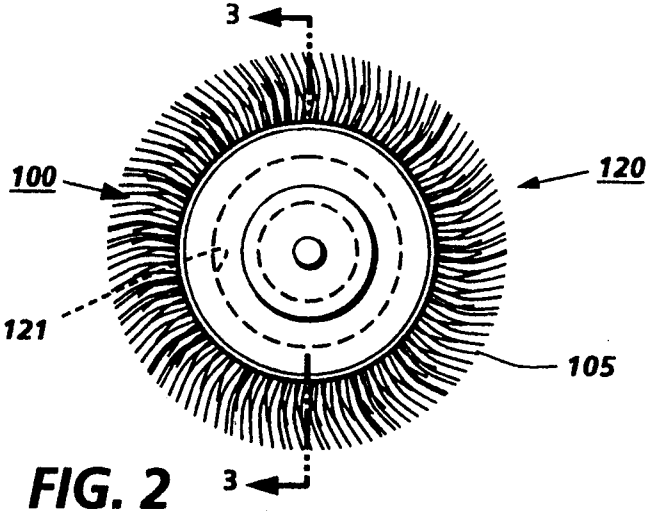
FIG. 2 is an elevational view of the ground strip cleaner of the present invention attached to the cleaner brush.
Figure 3:
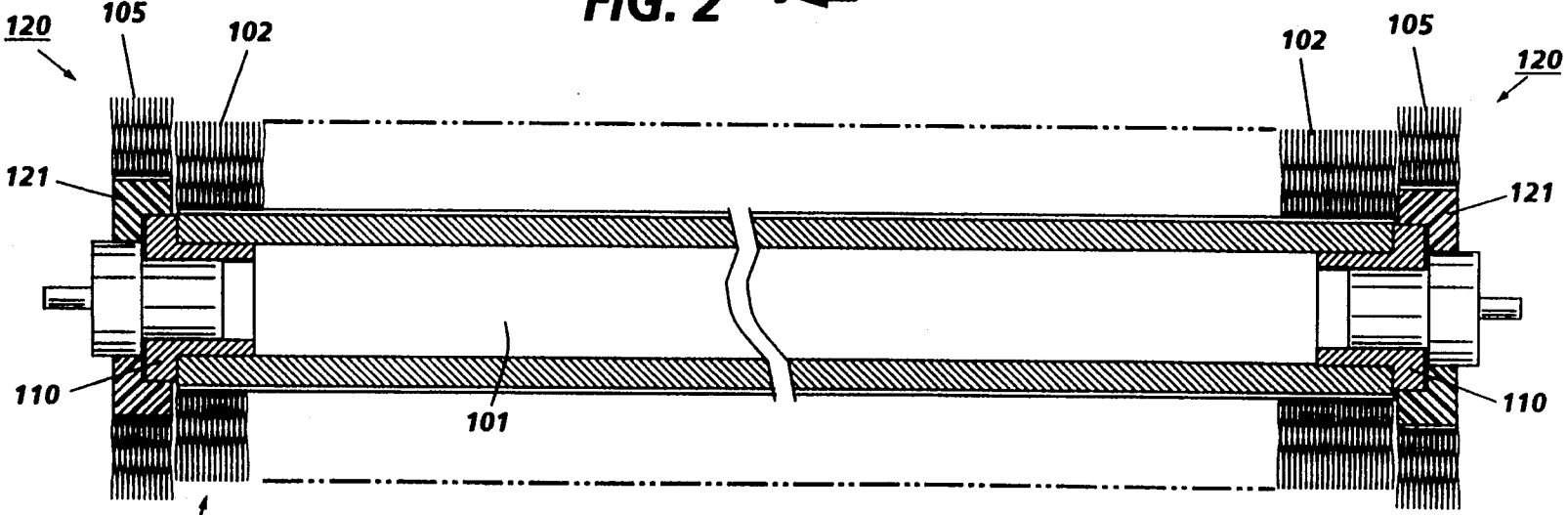
FIG. 3 is a sectional view taken along the line in the direction of the arrows 3—3 in FIG. 2.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 3 where the showings are for the purpose of illustrating a preferred embodiment of the invention and not for limiting the same.

Reference is now made to FIG. 1, which shows a planar view of the cleaning apparatus 92 shown in FIG. 4. The photoreceptor 10 rotates in the direction shown by arrow 12 about roller 14. The basic function of the electrostatic brush cleaner 100 is to carry a controlled voltage bias to remove charged toner and other debris from the photoreceptor surface 11. The cleaner brush removal of the residual toner and other particles from the photoreceptor surface 11, causes an accumulation of residual particles on the ground strip 130.

The ground strip 130 is commonly located along one edge of the photoreceptor belt, usually the outboard side (i.e. the side of the machine facing the operator). FIG. 1 shows an electrical ground strip 130 located on both sides of the photoreceptor belt 10. The ground strip is used to carry the applied voltage of the photoreceptor back to ground (i.e. it discharges the photoreceptor).

The electrostatic brush cleaner fibers are made from a conductive material. A short occurs when the conductive fibers contact a grounded surface such as the ground strip 130 and results in a print or copy quality defect. Therefore, the conductive brush 100 can not be used to clean the photoreceptor ground strip 130.

In order to clean the ground strip 130 without causing a short, the present invention is a brush ring or brush donut 120, attached to an end of the cleaner brush 100, to clean the ground strip 130 of residual particles. The rotational movement of the brush cleaner 100 to clean the photoreceptor surface 11, also rotates the brush donut 120 to clean the ground strip 130. The brush donut 120 is made of an insulative (nonconductive) material.

Reference is now made to FIG. 2, which shows a front elevational view of the present invention of a brush donut 120 used to clean the photoreceptor ground strip. The present invention consists of a circular piece 121 (i.e. hub) of any thermoplastic, nonconductive polyester (e.g. Teflon®) having a center hole similar to a donut or ring. Insulative material fibers 105 on a substrate material create the outer surface of the thermoplastic donut. The fibers 105 extend radially outward therefrom. Alternatives to the use of insulative fibers, in the present invention, include foam and rubber, made of nonconductive material, for the outer surface of the thermoplastic donut.

With continued reference to FIG. 2, the brush ring or donut 120 is made of insulative materials to prevent shorting as the fibers contact the ground strip. The width of the brush donut 120 (approximately 10 mm) is wide enough to slightly overlap the ground strip 130 onto the photoreceptor surface 11 (see FIG. 1). This eliminates the possibility of contact between the conductive cleaner brush fibers and the ground strip which would cause a short. The build up of toner on the ground strip that eventually leads to background on prints is also prevented.

Reference is now made to FIG. 3, which shows a cross-sectional view of section 3—3 of FIG. 2. The cleaner brush 100 consists of a core 101 with conductive fibers 102 extending radially outward therefrom. On either end of the cleaner brush core 101, there is an end cap 110. The brush donut 120 has a recessed hub 121 to allow the brush donut 120 to snap securely into place around the end cap 110.

The ground strip 130 is approximately 10–12 mm and so is the ground strip cleaning brush 120 is wide enough to cover the ground strip width and slightly overlap the photoreceptor on the side of the brush donut facing the electrostatic brush 100 end (see FIG. 1). This slight overlap of the photoreceptor surface by the brush donut 120 eliminates the potential for the brush conductive fibers to contact the ground strip and cause a short. The overall length of the brush with the added length of the end cap 110 is approximately 410 mm.

In recapitulation, the apparatus for cleaning particles from an imaging surface that has a ground strip along at least one edge of the image surface can be cleaned without shorting that can cause copy quality defects. The present invention adds a brush donut having non conductive fibers that do not short with the grounding strip. The brush donut overlaps the ground strip onto the imaging surface to eliminate the possibility of the primary brush cleaner, having conductive fibers, from contacting the ground strip that would cause a short. The brush donut is easily attachable to either end of the primary brush cleaner.

It is, therefore, apparent that there has been provided in accordance with the present invention, a ground strip cleaning apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface having an electrical ground strip along a marginal region of the surface, comprising:

a housing defining an open ended chamber;

a brush, rotatably mounted in the chamber of said housing, for removing particles from the surface; and means, attachable to said brush, for cleaning particles from the ground strip of the surface, said cleaning means being insulative to prevent shorting with the ground strip.

2. An apparatus as recited in claim 1, wherein said brush comprises:

a core; and a plurality of fibers extending radially outwardly from said core.

3. An apparatus as recited in claim 2, wherein said fibers are electrically conductive.

4. An apparatus as recited in claim 3, wherein said core of said brush comprises:

a first end; and a second end opposed from said first end, with said first end including a first end cap thereon and said second end including a second end cap, said first end cap and said second end cap allowing said cleaning means to attach easily thereto.

5. An apparatus as recited in claim 3, wherein said cleaning means comprises a donut shaped brush.

6. An apparatus as recited in claim 5, wherein said donut shaped brush rotates in unison with said brush.

7. An apparatus for cleaning particles from a surface having an electrical ground strip along a marginal region of the surface, comprising:

a housing defining an open ended chamber;

a brush, rotatably mounted in the chamber of said housing, for removing particles from the surface, said brush comprising a core and a plurality of electrically conductive fibers extending radially outwardly from said core, said core comprising a first end, and a second end opposed from said first end, with said first end including a first end cap thereon and said second end including a second end cap, said first end cap and said second end cap allowing said cleaning means to attach easily thereto; and means, easily attachable to said brush, for cleaning particles from the ground strip of the surface, said cleaning means comprises a donut shaped brush, said donut shaped brush comprises a hub, defining an aperture therein, and a plurality of fibers extending radially outwardly from said hub in frictional contact with the ground strip for removing particles therefrom.

8. An apparatus as recited in claim 7, wherein said first end cap snaps into the aperture in said hub, securely attaching said donut shaped brush adjacent one end of said brush.

9. An apparatus as recited in claim 7, wherein said fibers of said brush donut are electrically nonconductive.

10. An apparatus as recited in claim 7, wherein said hub is electrically nonconductive.

* * * * *